US011414979B2

(12) United States Patent
Santarelli

(10) Patent No.: US 11,414,979 B2
(45) Date of Patent: Aug. 16, 2022

(54) WELL INJECTION PROGRAM INCLUDING AN EVALUATION OF SANDFACE PLUGGING

(71) Applicant: Geomec Engineering Limited, London (GB)

(72) Inventor: Frederic Joseph Santarelli, Stavanger (NO)

(73) Assignee: GEOMEC ENGINEERING, LTD., London (GB)

( * ) Notice: Subject to any disclaimer, the term of this patent is extended or adjusted under 35 U.S.C. 154(b) by 180 days.

(21) Appl. No.: 16/767,641

(22) PCT Filed: Dec. 3, 2018

(86) PCT No.: PCT/GB2018/053487
§ 371 (c)(1),
(2) Date: May 28, 2020

(87) PCT Pub. No.: WO2019/110965
PCT Pub. Date: Jun. 13, 2019

(65) Prior Publication Data

US 2020/0370412 A1 Nov. 26, 2020

(30) Foreign Application Priority Data

Dec. 4, 2017 (GB) ..... 1720149

(51) Int. Cl.
*E21B 43/16* (2006.01)
*E21B 47/005* (2012.01)
(Continued)

(52) U.S. Cl.
CPC ..... *E21B 47/005* (2020.05); *E21B 33/138* (2013.01); *E21B 43/16* (2013.01); *E21B 43/34* (2013.01); *E21B 2200/20* (2020.05)

(58) Field of Classification Search
CPC ..... E21B 47/005; E21B 33/138; E21B 43/16; E21B 43/34; E21B 2200/20
See application file for complete search history.

(56) References Cited

U.S. PATENT DOCUMENTS 6,164,379 A 12/2000 de Oliveira
7,942,205 B2 * 5/2011 Sharif ..... E21B 43/40 166/371
(Continued)

FOREIGN PATENT DOCUMENTS

CN 202673267 U 1/2013
CN 104989359 A 10/2015
(Continued)

OTHER PUBLICATIONS

Intellectual Property Office of the UK Patent Office; Search Report for GB1720149.2; dated Apr. 23, 2018; one page; Newport, South Wales.
(Continued)

*Primary Examiner* — Silvana C Runyan
(74) *Attorney, Agent, or Firm* — Law Office of Jesse D. Lambert, LLC

(57) ABSTRACT

A method for providing a well injection program in which an evaluation of plugging of the sandface over time is included to more accurately determine the water treatment facility specifications and well injection parameters for a produced water re-injection well. An artificial produced water is provided which includes both water wet solids and oil wet solids being representative of the treated produced water to be injected, at solids and oil content concentrations magnitudes of order greater than the treated produced water. This allows filtration testing on small injected volumes suitable for standard laboratory equipment. The areal spurt loss and
(Continued)

Carter's Leak-Off coefficient are then determinable for use in evaluating the plugging of the sandface over time.

15 Claims, 4 Drawing Sheets

(51) Int. Cl.
*E21B 33/138* (2006.01)
*E21B 43/34* (2006.01)

(56) References Cited

U.S. PATENT DOCUMENTS 9,138,688 B2 * 9/2015 Prakash ..... B01D 71/024
2009/0044953 A1 * 2/2009 Sheth ..... E21B 43/128 166/369
2009/0050320 A1 2/2009 Collins et al.
2014/0311980 A1 * 10/2014 Weston ..... C02F 1/442 210/652
2016/0040522 A1 * 2/2016 Jacob ..... E21B 43/20 166/267
2016/0130155 A1 5/2016 Isogami et al.
2017/0241247 A1 * 8/2017 Parrella ..... E21B 43/164

FOREIGN PATENT DOCUMENTS

GB 2346636 A 8/2000
GB 2565034 A 2/2019
WO WO 2007/138327 12/2007

OTHER PUBLICATIONS

The International Bureau of WIPO; International Preliminary Report on Patentability for PCT/GB2018/053487; dated Jun. 9, 2020; pp. 1-8; Geneva, Switzerland.

* cited by examiner

WELL INJECTION PROGRAM INCLUDING AN EVALUATION OF SANDFACE PLUGGING

The present invention relates to injecting fluids into wells and more particularly, to a method for evaluating plugging of the sandface over time to better determine specifications for produced water treatment facilities for a produced water re-injection well in a well injection program.

Current hydrocarbon production is primarily focussed on maximising the recovery factor from a well. This is because we have already exploited all the areas which might contain oil leaving only those that are in remote and environmentally sensitive areas of the world (e.g. the Arctic and the Antarctic). While there are huge volumes of unconventional hydrocarbons, such as the very viscous oils, oil shales, shale gas and gas hydrates, many of the technologies for exploiting these resources are either very energy intensive (e.g. steam injection into heavy oil), or politically/environmentally sensitive (e.g. 'fracking' to recover shale gas).

To improve the recovery factor in a well it is now common to inject fluids, typically water, into the reservoir through injection wells. This form of improved oil recovery uses injected water to increase depleted pressure within the reservoir and also move the oil in place so that it may be recovered. When produced water is re-injected this also provides environmental benefits.

However, a disadvantage in using produced water for re-injection is in the solids and oil which are present within the produced water. Injecting these solids and oil create a filter cake at the sandface and produce sandface plugging. FIG. 1 of the drawings shows the resultant reduction in the injectivity index A and increase in the bottom hole pressure B over time C which sandface plugging creates. The sandface plugging is cumulative and consequently, there is the possibility that the well will lose all injectivity if fracture conditions cannot be reached by the pump system—i.e. insufficient pump pressure.

As a result of this, produced water is treated to remove oil droplets and solid particles. The complete chain of produced water treatment contains four stages. Taking the original separated water there will be initial contamination in the form of large oil droplets, small oil droplets, coarse solid particles, fine sold particles, charged particles and dissolved matter. The first stage is a pre-treatment which conditions the water stream in the upstream process. This removes the large droplets, coarse particles, aggregated charged particles and gas bubbles while reducing the dispersed contaminants. The facilities required for this include dehydration vessels, storage tanks, strainers etc. The second stage is the main treatment split into primary and secondary treatments. The primary treatment removes small droplets and particles using equipment such as skim tanks, API separators and plate pack interceptors. The secondary treatment removes smaller droplets and particles using equipment such as hydrocyclones, gas flotation and centrifuges. Stage three is the polishing treatment which can be considered as the final clean-up where water is to be re-injected for disposal or for produced water re-injection, or where feed is to pass to a tertiary treatment stage. This removes ultra-small droplets and particles along with dispersed hydrocarbons typically below 10 mg/l. The equipment used includes dual media filters, cartridge filters and membranes. The fourth stage is considered as the tertiary treatment used to produce an effluent stream of high quality typically when there are strict restrictions such as for BOD (biochemical oxygen demand) and heavy metals. This removes dissolved matter and gases plus dispersed hydrocarbons typically below 5 mg/l. These require processes such as gas and stream stripping, biological treatments and activated carbon absorption.

While the above details the ideal stages in treating produced water, space and weight limits will constrain what can be achieved particularly for offshore water treatment. Consequently, part of designing a well injection program is in determining the specifications for the water treatment facilities to provide treated produced water for re-injection with a sufficient reduction in oil droplets and solid particles with the minimum of equipment. This must be balanced against getting sufficient injectivity via specifying pump capacities and pressures to overcome the effects of sandface plugging.

Thus there is a need to be able to evaluate sandface plugging in any well injection program.

Prior art in the study of cake filtration of muds used in wells, which represent solid rich fluids i.e. several percent of solids volume per total volume, found that the cumulative volume (V) filtrated over a given surface area and under a given pressure differential varies as a function of the square root of time ($t^{1/2}$). This is as illustrated in FIG. 2, showing a plot of cumulative filtrate volume (ml) D against square root of time ($min^{1/2}$) E. The intercept F of the V vs. $t^{1/2}$ is known as spurt-loss. The slope G of the V vs. $t^{1/2}$ is known as leak-off coefficient. Both parameters can then be related to surface area leading to the areal spurt loss coefficient (SL) and Carter's leak-off coefficient (Clo). It is SL and Clo which govern the plugging of a sandface through which the fluid is filtrated and its evolution over time. For example, if we assume a fracture with a given height, its length will be directly proportional to Carter's leak-off coefficient for any given injection rate and duration of injection.

These experiments for muds are based on filtration on a 40 μm disk at 34.5 bar pressure with a cumulative filtrate volume in the region of 5 to 9 ml. Thus they can be performed using standard laboratory equipment. If we attempt to do similar laboratory testing of our produced water for a typical sandface area and injection rate, we find that as the treated water contains only tens of ppm (say, 40 ppm) each of oil droplets and solids with diameters of less than tens of microns (say, 20 μm), to create a filter cake volume 2 mm in thickness would require something in the order of 0.2 $m^3$ of produced water. Such a volume of produced water is impractical for laboratory based filtration experimentation.

Consequently when petroleum engineers develop a produced water well re-injection program they currently apply an order of magnitude to guess-estimate Carter's leak-off coefficient, which leads to great uncertainty with respect to the length of the fractures to be expected.

It is therefore an object of at least one embodiment the present invention to provide a method for a produced water well re-injection program in which an evaluation of plugging of the sandface is included.

It is a further object of at least one embodiment of the present invention to provide a method for a produced water well re-injection program in which laboratory scale experiments can be used to determine more accurate values for parameters used to evaluate plugging of the sandface over time.

According to a first aspect of the present invention there is provided a method for a well injection program, comprising the steps:

(a) determining characteristics of pre-treated injection fluid;

(b) estimating characteristics of treated injection fluid;

(c) using the estimated characteristics to evaluate plugging of the sandface over time;

(d) specifying fluid treatment facilities for the pre-treated injection fluid to provide the treated injection fluid which, when injected, will account for the plugging of the sandface over time.

In this way, the injectivity index can be maintained through the well injection program to ensure fracture extensions occur.

Preferably the pre-treated injection fluid is the produced fluids from a well. Preferably the treated injection fluid is treated produced water. In this way the well injection program is a produced water re-injection program.

Preferably the characteristics of the treated injection fluid are solids and oil in water content and size.

Preferably step (b) further comprises the steps of:

i. creating an artificial produced water, the artificial produced water having a concentration of solids and oil being a multiple of that in the treated produced water;

ii. testing a volume of artificial produced water, the volume being suitable for use in standard laboratory equipment;

iii. measuring cumulative volume filtrated through a filtration medium with respect to time for the artificial produced water being tested;

iv. converting the cumulative volume filtrated into volume of solids and oil retained over a surface of the filtration medium being the cumulative filtrate volume;

v. multiplying the cumulative filtrate volume to reverse the concentration of step (i) and providing a determination of treated produced water cumulative filtrate volume;

vi. determining the areal spurt loss coefficient (SL) and Carter's leak-off coefficient (Clo) from the treated produced water cumulative filtrate volume against square root of time; and thereby evaluating plugging of the sandface over time.

In this way, small injected volumes can be created which allows use of standard laboratory equipment.

Preferably in step (i) the concentration (vol/vol) of solids and oils is multiplied to increase the concentration by between 2 and 4 orders of magnitude. More preferably, the concentration (vol/vol) of solids and oils is multiplied to increase the concentration by 3 orders of magnitude.

Preferably the artificial produced water includes artificial solids being one or more materials representing the solids in the treated produced water. In this way, materials available in the laboratory can be used. The materials may be selected from a group comprising: sieved sand, CaCO3 and some lost circulation materials. Those skilled in the art will recognize lost-circulation materials as commonly being fibrous (e.g. cedar bark, shredded cane stalks, mineral fiber and hair), flaky (e.g. mica flakes and pieces of plastic or cellophane sheeting) or granular (e.g. ground and sized limestone or marble, wood, nut hulls, Formica, corncobs and cotton hulls). Preferably, the artificial solids are selected to have a particle size distribution matching a likely particle size distribution for the solids in the treated produced water. The particle size distribution may be in a range not greater than nm to μm.

Preferably the artificial produced water includes water wet artificial solids and oil wet artificial solids. In this way the wettability of the solids is accounted for as it is known that oil wet solids will give a much lower permeability to the filter cake than water wet solids. The artificial solids will typically be water wet but can be made, at least partly, oil wet by ageing in selected crude oil, for example.

Preferably, the method includes the additional steps of:

(e) modelling fracture extension in formation of the well; and (f) determining pump capacities required to achieve desired fracture extensions.

In this way, an iterative process is created for the well injection program.

Preferably, the method includes the further step of providing specifications for the pump type and capacity. More preferably the capacity will be in terms of rate and pressure. In this way, the well injection program can operate more efficiently and cost effectively while having sufficient volume and pressure of the injected fluid.

The treated injection fluid may be further treated such as with a bactericide or scale inhibitor.

Preferably the method includes the further step of determining well injection parameters for the pumped fluid. Preferably the well injection parameters are selected from a group comprising: injection fluid temperature, fluid pump rate, fluid pump duration and fluid injection volume.

Preferably, the method includes the further step of carrying out well injection using the well injection parameters.

Accordingly, the drawings and description are to be regarded as illustrative in nature and not as restrictive. Furthermore, the terminology and phraseology used herein is solely used for descriptive purposes and should not be construed as limiting in scope languages such as including, comprising, having, containing or involving and variations thereof is intended to be broad and encompass the subject matter listed thereafter, equivalents and additional subject matter not recited and is not intended to exclude other additives, components, integers or steps. Likewise, the term comprising, is considered synonymous with the terms including or containing for applicable legal purposes. Any discussion of documents, acts, materials, devices, articles and the like is included in the specification solely for the purpose of providing a context for the present invention. It is not suggested or represented that any or all of these matters form part of the prior art based on a common general knowledge in the field relevant to the present invention. All numerical values in the disclosure are understood as being modified by "about". All singular forms of elements or any other components described herein are understood to include plural forms thereof and vice versa.

While the specification will refer to up and down along with uppermost and lowermost, these are to be understood as relative terms in relation to a wellbore and that the inclination of the wellbore, although shown vertically in some Figures, may be inclined or even horizontal.

Embodiments of the present invention will now be described, by way of example only, with reference to the accompanying Figures, of which:

Figure 3:
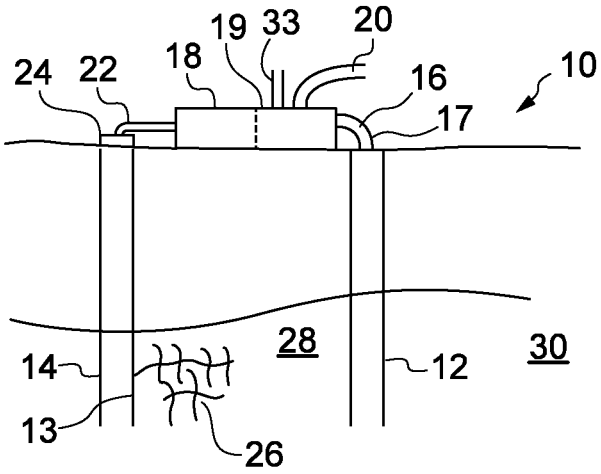
FIG. 3 is a schematic illustration of a field development including a production well and an injection well on which produced water re-injection is carried out in accordance with a well injection program according to an embodiment of the present invention.

Reference is initially made to FIG. 3 of the drawings which illustrates an oilfield development for produced water re-injection, generally indicated by reference numeral 10, having a production well 12 and an injection well 14. Produced hydrocarbons 16 and produced water 17 from well 12 enter a treatment facility 18. Hydrocarbons 16 and produced water 17 are separated in the facility 19, with gas 33 produced and oil 20 being exported for sale. The produced water 17 is treated and the treated produced water 22 is injected into an injection well 14 using pumps 24.

The re-injected produced water 22 enters and extends fractures 26 in the rock formation 28 within a reservoir 30. This injection of fluid increases depleted pressure within the reservoir 30 and also moves the oil 20 in place so that it may be produced through the production well 12.

Those skilled in the art will recognise that the injection well 14 may be a previously producing well. Additionally, the injection well 14 may be used to enhance production from an alternative production well to the one in which the produced water was obtained. Further there may be a number of injection wells in the field development. The illustration is also shown as an onshore development but could equally apply to an offshore development including platforms, FPSO and possible support vessels.

As the injected fluid 22 enters the formation 28 it crosses the sandface 13 which is the physical interface between the wellbore 14 and the formation 28. It includes the surface area of all the perforation tunnels and along the lengths of all the fractures 26. Entry of fluids to the formation is based on the bottom hole pressure together with the physical properties of the formation such as its permeability and porosity. Any materials in the fluid greater than a fraction of the pore size will be stopped at the sandface and create a filter cake—e.g. $\frac{1}{3}^{rd}$ This filter cake effectively plugs the sandface and the passage of fluids into the formation then becomes dependent on the thickness and properties of the filter cake.

Figure 1:
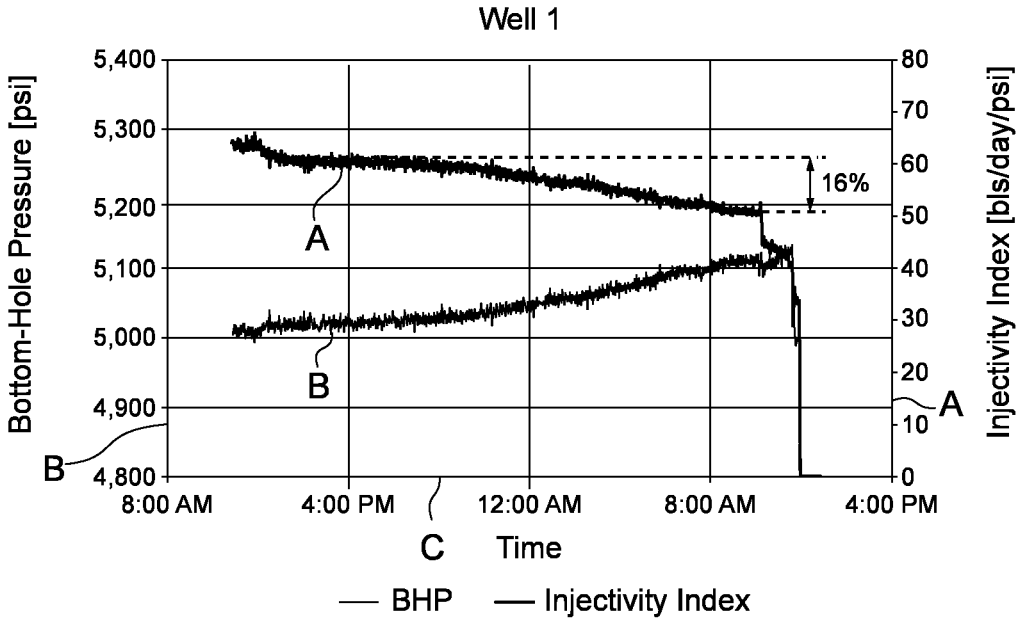
FIG. 1 is a graph of injectivity index and bottom-hole pressure against time, illustrating the effect of plugging of the sandface over time in an injection well.

The injection conditions are typically measured as bottom-hole pressure and injectivity index. Referring to FIG. 1 of the drawings shows the resultant reduction in the injectivity index A and increase in the bottom hole pressure B over time C which sandface plugging creates, when injecting below fracture pressure. The sandface plugging is cumulative and consequently, there is the possibility that all injectivity will be lost if there is not enough pump pressure available to trigger fracturing, which negates the benefit of water injection.

During production development operations a well injection program 50 is developed. Reservoir models are used to analyse, optimise, and forecast production. Such models are used to investigate injection scenarios for maximum recovery and provide the injection parameters for the well injection program. The process 50 to design a produced water re-injection program is iterative and the steps illustrated in FIG. 4. The reservoir engineer may begin with a fracture extension model 52 for a desired recovery of hydrocarbons based on geological, geophysical, petrophysical, well log, core, and fluid data collected from the reservoir 30. For the desired recovery the engineer will then calculate the volume and pressure of injected fluids required to achieve this. A determination of the pump capacity required (rate and pressure) 54 then follows. The engineer must then consider the fluid components. A quantity of fluid may be given over to additives and the rest made up of treated produced water 22, bearing in mind the quantity of produced water 17 available. Consideration must also be given to the solids and oil in water content 56 of the injected treated produced water 22. These will determine the water treatment facility 18 specifications required for treating the produced water 17. They will also account for the sandface plugging 58 identified above which will trigger further fracture extension. Thus the process 50 becomes iterative.

The design of the pump capacities 54 (pressure) and modelling of the fracturing of the formations 52 require knowledge of the large scale thermal stress coefficient.

The present Applicants have a co-pending application GB1708293.4 which discloses a method for providing a well injection program in which injection testing is performed on an existing well which is intended to be an injection well in a field development. Water is injected into the well in a series of step rate tests or injection cycles, the data is modelled to determine thermal stress characteristics of the well and by reservoir modelling the optimum injection parameters are determined for the well injection program to provide for maximum recovery. The injection parameters are typically injection fluid temperature, fluid pump rate, fluid pump duration and fluid injection volume.

While this provides for obtaining knowledge of the thermal stress characteristics and a set of predicted injection parameters, it cannot predict the sandface plugging over time. Currently, the well injection program 50 models the plugging of the sandface 58 using an order of magnitude variation i.e. we assume a factor of ten on the values to cover the possible effects of sandface plugging.

The present invention seeks to provide a more accurate evaluation of plugging of the sandface. It also recognises that the creation of the filter cake is cumulative and thus the plugging of the sandface is a time dependent parameter.

The treated produced water 22 from the arrangement of FIG. 3 typically contains tens of ppm of oil droplets and tens of ppm of solids. The diameter of the oil droplets and the solids is typically less than tens of microns.

Figure 2:
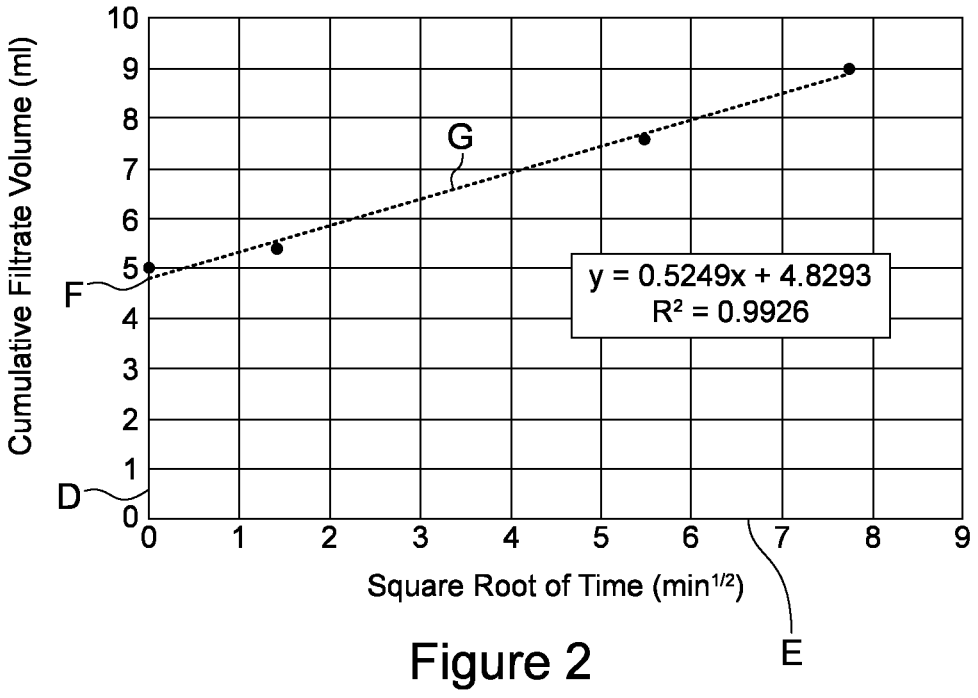
FIG. 2 is graph of cumulative filtrate volume against the square root of time from which parameters governing the plugging of a sandface can be determined.

In order to evaluate the plugging of the sandface such an amount of solids and oil droplets will create we look to work done on filtration. Chi Tien (2010) Introduction to Cake Filtration: Analyses, experiments and Applications. Elsevier, 279p. provides general filtration theory from a chemical, biomedical background. Within the oil and gas industry, there have been studies of cake filtration of muds used in wells. The API RP 13: HPHT static filtration tests looked at filtration on disks with given pore throats—i.e. 40 mm in the example used here—and at a given pressure—i.e. at 34.5 bar pressure in the example shown here—with a cumulative filtrate volume in the region of 5 to 9 ml. The static results show an increase in cumulative filtrate volume, as would represent the filter cake, as expected. An analysis of these results found that the cumulative volume (V) filtrated over a given surface area and under a given pressure differential varies as a function of the square root of time ($t^{1/2}$). This is as illustrated in FIG. 2, showing a plot of cumulative filtrate volume (ml) D against square root of time ($min^{1/2}$) E. The intercept F of the V vs. $t^{1/2}$ is known as spurt-loss. The slope G of the V vs. $t^{1/2}$ is known as leak-off coefficient. Both parameters can then be related to surface area leading to the areal spurt loss coefficient (SL) and Carter's leak-off coefficient (Clo). It is SL and Clo which govern the plugging of a sandface through which the fluid is filtrated and its evolution over time.

These results were performed on muds which represent solid rich fluids i.e. several percent of solids volume per total volume. The experiments for muds are based on filtration with a cumulative filtrate volume in the region of 5 to 9 ml. Thus they can be performed using standard laboratory equipment.

If we consider replacing the mud in these experiments with our treated produced water, we have the following parameters to consider in the creation of the filter cake:

Perforated Length: 10 m

Sandface at Perforation Tunnels: 10 $m^2$

Injection Rate: 1000 $m^3$/d

Solids Content in the Water: 20 ppm

Volume Deposited on the Perforation Sandface in One Day: 0.02 $m^3$

Thickness of the Solids (incompressible): 2 mm

These represent a typical matrix injection in a produced water re-injection well. Assuming that only solids contribute to the filter cake volume with full sandface retention, the laboratory conditions needed would be:

Disk/Plug Diameter: 2" (50.8 mm)

Filtration Area: 2.03E-03 $m^2$

Solids Content in the Water: 20 ppm

Required Thickness of Solids: 2 mm

Required Volume of Produced Water: 0.203 $m^3$

For this volume of produced water we cannot use laboratory scale experiments.

Figure 5:
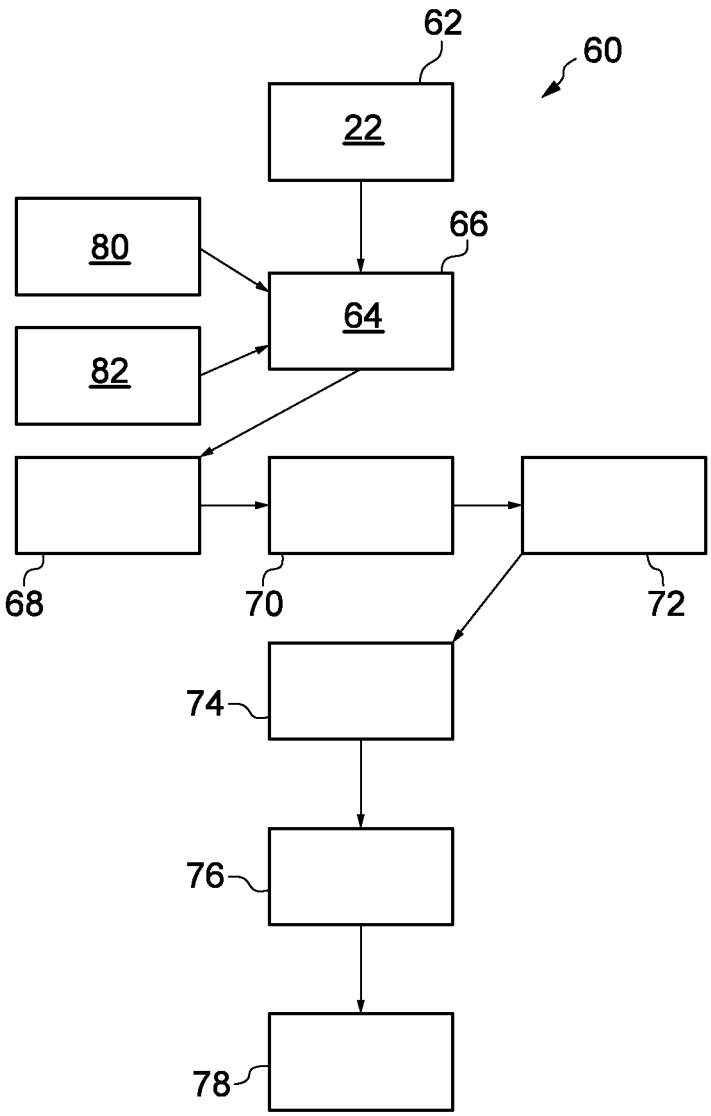
FIG. 5 is a flow chart of a methodology for evaluating plugging of the sandface over time according to an embodiment of the present invention.

Referring now to FIG. 5 of the drawings there is illustrated a methodology 60 for obtaining the areal spurt loss coefficient (SL) and Carter's leak-off coefficient (Clo) for evaluating the plugging of the sandface over time from produced water.

The first step 62 is to determine the characteristics of the treated produced water 22 which is intended as the injection fluid. These characteristics will be the concentration of solids and oil (vol/vol) and the particle size. The values may be measured from treated produced water samples or be estimated from the components of the produced water treatment facility 18 considered in the well injection program 50.

An artificial produced water sample 64 representative of the treated produced water 22 is then created 66. However, the concentration (vol/vol) of solids and oils in the sample 64 is increased to be orders of magnitude greater than in the treated produced water. The concentration may be multiplied up to provide an order of magnitude increase of between two and four times. In the preferred embodiment it is a three times order of magnitude increase. By doing this we are able to limit the amount of fluid to be filtrated by similar orders of magnitude and thus we can test with small injected volumes.

The next step 68 is then to use standard laboratory equipment for static filtration. This equipment and procedures are as known in the art of chemical analysis. Static filtration testing can be carried out using core plugs or porous ceramic discs (Hassler cell, HPHT API filtration cells, etc.) on the artificial water sample 64.

In the test 70 measurement of the cumulative volume filtrated through the medium with respect to time for the tested fluid with expected over-balance, is made.

A conversion step 72 is carried out in which the measure the cumulative volume filtrated is converted into a volume of solids and oil retained over the filtration surface. In this conversion it is first assumed that there is full retention on the surface but specific tests of the filtrate could be used to modify the assumption if desired. This provides the cumulative filtrate volume against time.

A dissolution factor is then applied 74 to convert the results from the artificial water sample 64 to the treated produced water 22 real case. This multiplies back up the volumes to match the original concentrations giving a treated produced water cumulative filtrate volume. Numerically this effectively stretches the y-axis on the graph of cumulative filtrate volume against time.

As with the prior art, a determination of the areal spurt loss coefficient (SL) and Carter's leak-off coefficient (Clo) is obtained from the treated produced water cumulative filtrate volume against square root of time graph, as illustrated in FIG. 2, in step 76.

The areal spurt loss coefficient (SL) and Carter's leak-off coefficient (Clo) are then used 78, in the well injection program process 50 of FIG. 5, to evaluate the plugging of the sandface over time (leak-off) 58.

Step 66 of the methodology 60 requires the creation of an artificial produced water sample 64. This requires to be representative of the solids and oils present in the treated produced water 22. It is important for the testing 70 as the filter cake thickness is primarily governed by the amount of solids retained and to a lesser extent by the amount of oil retained. The filter cake permeability is governed by the particle size distribution (PSD) of the solids and the affinity between the oil and the solids deposited on the filtration surface.

In terms of particle size, the specification of sand removal in the facility 18 at the sand cyclone 44 will typically remove over 90% of particles with diameters greater than nm to μm in size.

The solids are produced artificially from materials readily available in the laboratory and on which the particle sizes can be adjusted or selected to be within the desired particle size distribution required. Typically the materials will be sieved sand, CaCO3 and granular lost circulation materials. Those skilled in the art will recognize lost-circulation materials as commonly being fibrous (e.g. cedar bark, shredded cane stalks, mineral fiber and hair), flaky (e.g. mica flakes and pieces of plastic or cellophane sheeting) or granular (e.g. ground and sized limestone or marble, wood, nut hulls, Formica, corncobs and cotton hulls). Preferably, the artificial solids are selected to have a particle size distribution matching a likely particle size distribution for the solids in the treated produced water. The particle size distribution may be in the range of nm to μm.

The wettability of the solids must now be considered. The artificial produced water must represent water wet solids 80 and oil wet solids 82. This is because oil wet solids will give a much lower permeability to the filter cake than water wet solids. While the artificial solids available in the laboratory will typically be water wet these can be made, at least partly, oil wet by ageing in selected crude oil, for example.

Care must be taken on the quantities of oil droplets with oil wet solids as we do not wish these to merge, wither together or for larger oil droplets to form. The oil droplets must remain in suspension. If merging occurs it produces an aquaphobic deposit on the filtration surface which will cause total impermeability of the filter cake created on the filtration surface. This will be seen as a levelling off on the graph of FIG. 2 such that the slope F of the V vs. $t^{1/2}$ and the leak-off coefficient is zero.

Consideration may also be given to other fluids which may be added to the treated produced water 22 such as bactericides and scale inhibitors.

Such an accurate determination of the plugging of the sandface allows for the petroleum engineer to define the characteristics in terms of particles and oil droplet size and content for the treated injection fluid 22. This in turn allows specifications for the produced water 17 treatment facilities 18 to be correctly determined to achieve the fracture lengths 52 which are themselves based on the sandface leak-off capacities.

Figure 4:
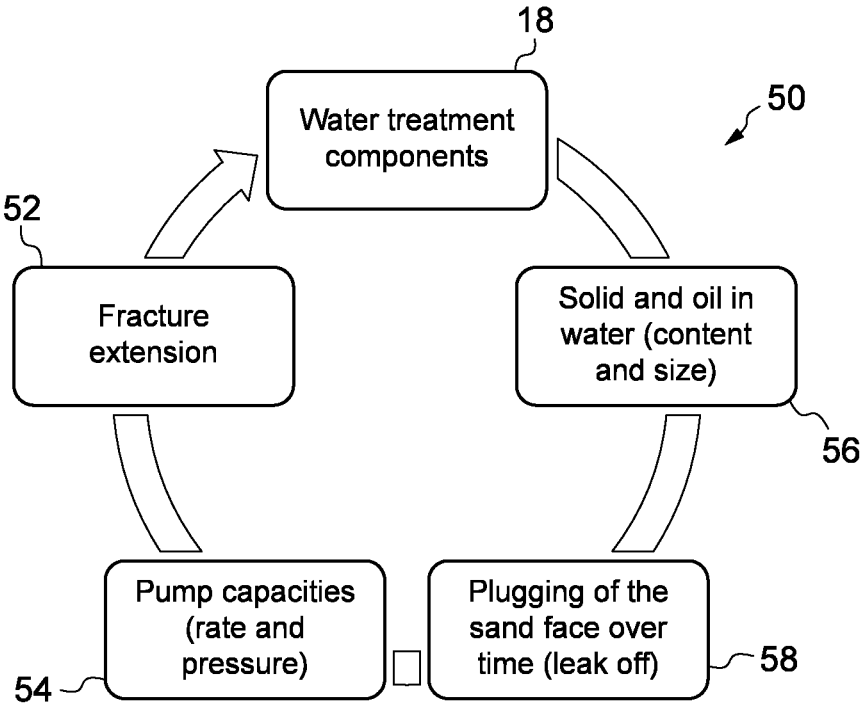
FIG. 4 is a flow chart of a methodology according to an embodiment of the present invention.

By iteratively going through the methodology of FIG. 4 and using sandface evaluation measurements from the laboratory at step 58 (by reference to a database of the laboratory measurements, if prepared), an optimum scenario for a well injection program 50 can be presented.

From the produced fluid (hydrocarbons 16 and produced water 17) characteristics, the specifications for the water treatment facilities 18 can be determined. The pump 24 types and their capacities in terms of rate and pressure can also be specified. The fracture modelling will now provide well injection parameters in terms of injection fluid temperature, fluid pump rate, fluid pump duration and fluid injection volume to achieve the modelled production. It is seen from FIG. 1 that such injection parameters will now be time dependent to overcome the drop in injectivity index which is predicted due to plugging of the sandface 13. The modelling can therefore be done in real time and adjustments made to account for the time dependency on variables such as the plugging of the sandface 13 and the thermal stress characteristics in the injection well 14.

Figure 6:
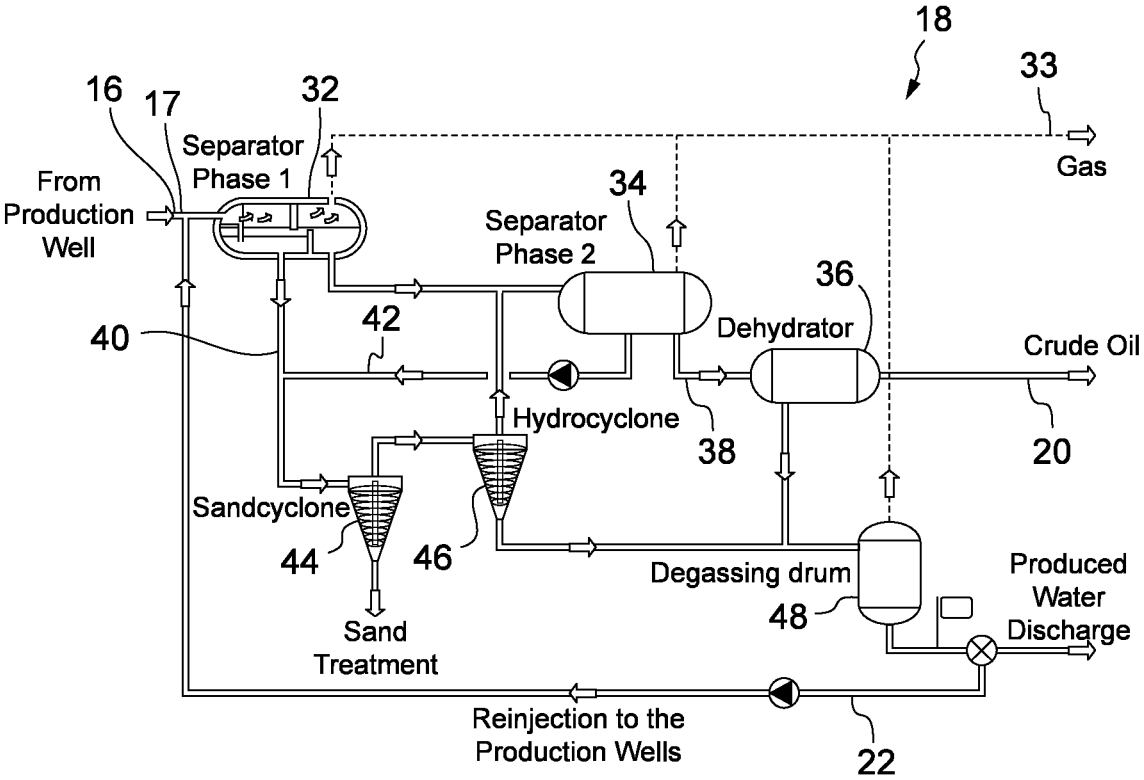
FIG. 6 is a schematic illustration of a typical offshore treatment facility for produced water.

In terms of specifying the components for a suitable produced water treatment facility 18 we now refer to FIG. 6, where there is illustrated a typical offshore treatment facility 18 for treated produced water 22. Typically, the stream of produced hydrocarbons 16 and produced water 17 being produced fluid from a production well 12 is passed through two oil and water separator tanks 32,34 which also removes gas 33. This may be considered as a separation section 19. A dehydrator 36 treats the oil stream 38 from the second separator tank 34 to obtain crude oil 20, with water streams 40,42 passing through a sandcyclone 44, hydrocyclone 46 and degassing drum 48. The size, capacity and operating requirements for each piece of equipment 32,34,36,44,46 and 48 can be determined to provide treated produced water 22 so that it contains the desired size and content of oil droplets and particles. Typically the treated produced water 22 contains tens of ppm of oil droplets and tens of ppm of solids (40 ppm). The diameter of the oil droplets and the solids is typically less than tens of microns (20 μm). Further water treatment components may need to be used as described hereinbefore, but their selection and operating requirements will have been determined using the methodology of the present invention.

Advantageously, only the minimum requirements sufficient to provide the required amount of treated produced water with the desired characteristics for successful re-injection will be specified.

The principle advantage of the present invention is that it provides a method for a well injection program in which an evaluation of plugging of the sandface over time is included.

A further advantage of at least one embodiment of the present invention is that it provides a method for a well injection program in which laboratory scale experiments can be used to determine more accurate values for parameters used to evaluate plugging of the sandface over time.

A still further advantage of at least one embodiment of the present invention is that it provides a method for determining the specifications of a produced water treatment facility in a produced water well re-injection program.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended. For example, while the methodology assumes that all the water treatment components may be selected, some of these may instead be fixed by virtue of an existing water treatment facility being adapted for use.

I claim:

1. A method for a well injection program in which a produced water is passed through produced water treatment facilities to alter concentration of solids and oil and so provide a treated produced water for injection by pumping into the well, the well including a sandface, comprising the steps:

(a) determining a concentration of solids and oil in the produced water;

(b) estimating a concentration of solids and oil in the treated produced water;

(c) creating an artificial produced water, the artificial produced water having a concentration of solids and oil being a multiple of that in the treated produced water;

(d) testing a volume of artificial produced water, the volume being suitable for use in standard laboratory equipment;

(e) measuring cumulative volume filtrated through a filtration medium with respect to time for the artificial produced water being tested;

(f) converting the cumulative volume filtrated into volume of solids and oil retained over a surface of the filtration medium being a cumulative filtrate volume;

(g) multiplying the cumulative filtrate volume to reverse the concentration of solids and-oils in step (a) and providing a determination of treated produced water cumulative filtrate volume;

(h) determining areal spurt loss coefficient (SL) and Carter's leak-off coefficient (Clo) from the treated produced water cumulative filtrate volume against square root of time; and thereby evaluating plugging of the sandface over time in the well by injection of the treated produced water.

2. The method for a well injection program according to claim 1 wherein in step (c) the concentration of solids and oils is multiplied to increase the concentration by between 2 and 4 orders of magnitude.

3. The method for a well injection program according to claim 2 wherein the concentration of solids and oils is multiplied to increase the concentration by 3 orders of magnitude.

4. The method for a well injection program according to claim 1 wherein the artificial produced water includes artificial solids being one or more materials representing the solids in the treated produced water.

5. The method for a well injection program according to claim 4 wherein the materials are selected from a group consisting of sieved sand, $CaCO_3$ and lost circulation materials.

6. The method for a well injection program according to claim 4 wherein the artificial solids are selected to have a particle size distribution matching a particle size distribution for the solids in the treated produced water.

7. The method for a well injection program according to claim 6 wherein the particle size distribution is in a range of 1 μm to 1 nm.

8. The method for a well injection program according to claim 4 wherein the artificial produced water includes water wet artificial solids and oil wet artificial solids.

9. The method for a well injection program according to claim 1 wherein, the method includes the additional steps of:

(i) modelling fracture extension in formation of the well; and (j) determining pump capacities required to achieve desired fracture extensions.

10. The method for a well injection program according to claim 9 wherein the method includes the further step of providing specifications for pump type and capacity.

11. The method fora well injection program according to claim 10 wherein the capacity is in terms of rate and pressure.

12. The method for a well injection program according to claim 1 wherein the treated produced water is further treated with a bactericide or scale inhibitor.

13. The method for a well injection program according to claim 1 wherein the method includes a further step of determining well injection parameters for the treated produced water.

14. The method for a well injection program according to claim 13 wherein the well injection parameters are selected from a group consisting of injection fluid temperature, fluid pump rate, fluid pump duration and fluid injection volume.

15. The method for a well injection program according to claim 13 wherein the method includes the further step of carrying out well injection using the well injection parameters.

* * * * *